United States Patent [19]

Boswell et al.

[11] Patent Number: 5,074,908

[45] Date of Patent: Dec. 24, 1991

[54] METHOD FOR SIMULATANEOUSLY MECHANICALLY ALLOYING METALS AND PLATING PARTS WITH THE RESULTING ALLOYS

[75] Inventors: Peter Boswell, Carouge; Guy Negaty-Hindi, Onex, both of Switzerland

[73] Assignee: Battelle Memorial Institute, Carouge/GE, Switzerland

[21] Appl. No.: 554,671

[22] Filed: Jul. 19, 1990

[30] Foreign Application Priority Data

Jul. 20, 1989 [EP] European Pat. Off. ..... 89810549.9

[51] Int. Cl.[5] ..... C23C 24/04

[52] U.S. Cl. ..... 75/352; 427/216; 427/217; 427/242

[58] Field of Search ..... 75/352; 427/216, 217, 427/242

[56] References Cited

U.S. PATENT DOCUMENTS 4,655,832 4/1987 Omori et al. ..... 427/242

FOREIGN PATENT DOCUMENTS 1144076 2/1963 Fed. Rep. of Germany .
946960 6/1949 France .
2450281 9/1980 France .
937009 6/1982 U.S.S.R. .
883128 11/1961 United Kingdom .

*Primary Examiner*—R. Dean
*Assistant Examiner*—Margery S. Phipps
*Attorney, Agent, or Firm*—Cushman, Darby & Cushman

[57] ABSTRACT

Tubes partly filled with a blend of two or more metals in powder form and containing loose hard bodies are subject to linear and oscillating motion; under the impact of the bodies knocking against each other, the metals alloy together mechanically and form a patterned amorphous coating on the surface of the clashing bodies.

5 Claims, 2 Drawing Sheets

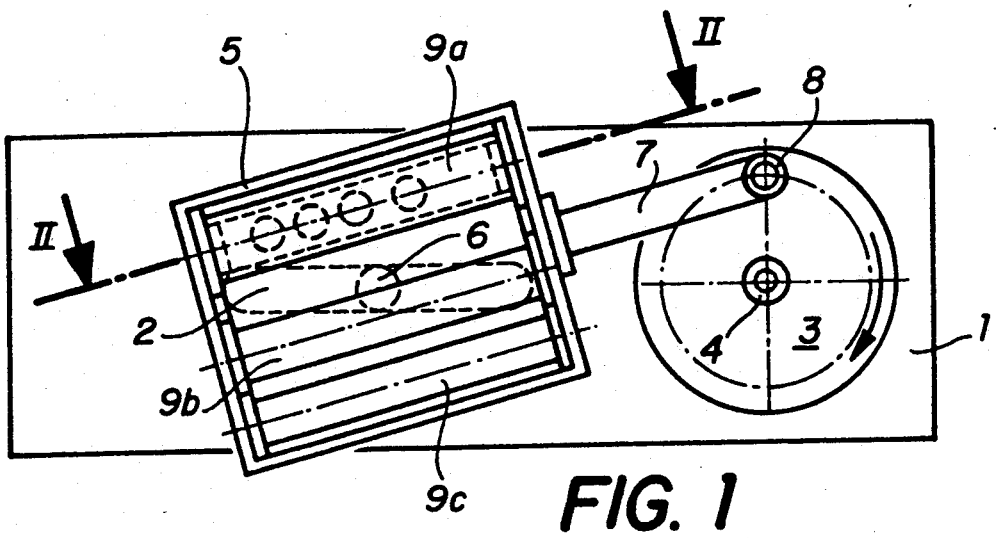
FIG. 1
FIG. 2
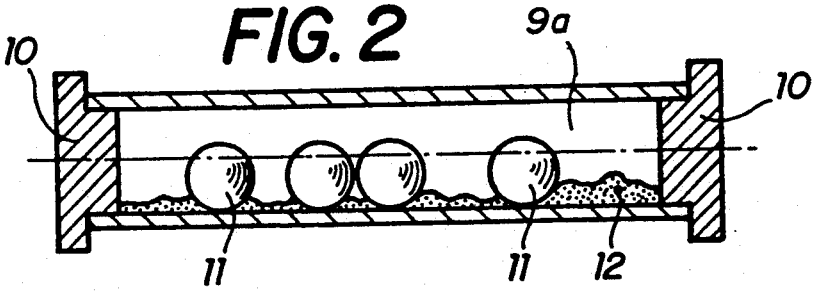
FIG. 4
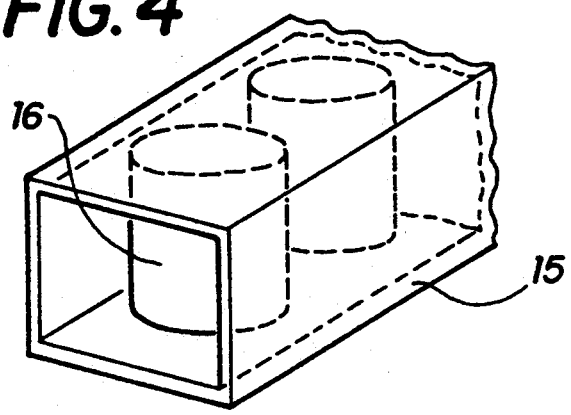
FIG. 3
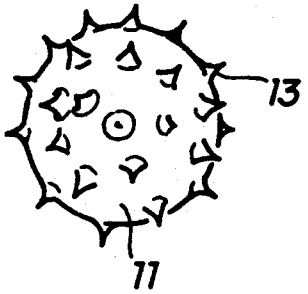

METHOD FOR SIMULATANEOUSLY MECHANICALLY ALLOYING METALS AND PLATING PARTS WITH THE RESULTING ALLOYS

BACKGROUND OF THE INVENTION

1. Field of the Invention

The present invention concerns a method for mechanically alloying a metal with one or more other metals or mineral constituents and mechanically coating the alloy on still or moving parts.

2. Description of the Prior Art

Mechanical alloying is a well-known technique involving repeated welding, fracturing and rewelding of powder particles in a dry, high-energy ball charge. This technique has been exploited to alloy two or more metals together, particularly metals non-miscible in one another, and to intimately disperse mineral phases (e.g. ceramics) into metal matrices. Mechanical alloying generally procures alloys in a highly metastable state similar to that from rapid vapour or melt quenching. This technique is widely discussed in the following review: "Mechanical Alloying" by R. Sundaresan and F. H. Froes, Journal of Metals (August 1987) p. 22–27, and the references cited therein.

Generally, the particulate materials to be mechanically alloyed are violently agitated in a ball mill with very hard freely moving bodies (e.g. steel or ceramic balls) under an inert atmosphere (e.g. argon). It does not appear that, until now, the conditions prevailing in mechanical alloying can lead to the coating of surfaces (attritor bodies or other moving or still objects in the mill) with the newly formed alloy.

The reason why this is so is not clear but probably relates to friction between the moving bodies in addition to the high impact energy involved in mechanical alloying.

Actually, the process of forming a metastable alloy by mechanical alloying follows the stages outlined below:

- cladding of the component powder on the surface of the stricken media with a dynamic equilibrium between the clad material and the loose powder;
- progressive reduction in the size of the clad component particles which are generally in the form of flattened lamellae;
- simultaneous solid-state atomic intermixing at the lamellae interfaces to give the metastable alloy.

Since the metastable alloy formed is generally brittle, then once the solid-state mixing condition becomes extensive, the alloyed material tends to become loose and drops from the outer surface of the plated media. Eventually, the surface of the media carries only an unsignificant amount of alloy or not at all.

It is however known that under less hard conditions, and using relatively soft metals, plating normally occurs. This is the basis of conventional mechanical plating, another well-known technique in which a metal or alloy in powder form is blasted toward surfaces to be coated with a layer of this metal together with peening particles, e.g. metal or glass shot (see EP-A-170.240). Otherwise, parts to be plated are wet tumbled in a barrel with a metal powder and glass beads (see GB-A-1,184,098). A machine for mechanically plating small parts using a barrel that simultaneously rotates and vibrates is disclosed in U.S. Pat. No. 3,494,327. Other references on mechanical plating are U.S. Pat. No. 4,552,784 and FR-A-2.450.281.

It was therefore of great interest to combine both techniques and achieve mechanical plating with newly mechanically alloyed material, using the same installation for successively or simultaneously performing both operations.

The Official Search Report has uncovered the following documents:

(1) FR-A-946.960 discloses a mechanical plating and alloying technique in which a circular enclosure containing parts to be plated, metal powders which may comprise one or several different metals and striking bodies (balls) is subjected to off-centered giration, whereby the metal powders agglomerate and alloy together under impact from the balls and a layer of this allow will form over the parts to be plated.

(2) Document DE-B-1.144.076 discloses a method for the plating of glass or plastic articles with a metal layer deposited mechanically. In this method, the parts to be plated, a metal powder, optional particulate materials, and non-metal additives (such as polymeric resins, graphite, metal sulfides and the like) are tumbled in a rotating drum. During plating, the non-metal additives co-precipitate with the metal powder and form a composite layer on the parts to be plated.

(3) Document GB-A-883,128 discloses the drum-plating of steel balls with molybdenum sulfide which will form this dry-lubricating layers (1 $\mu$m) on the ball surface by tumbling together with $MoS_2$ powder.

(4) Document EP-A-293.228 discloses a plating technique in the vapour phase by spraying a jet of plasma on the parts to be plated.

SUMMARY OF THE INVENTION

The method of the present invention differs from the cited prior art as defined in claim 1 and subsequent claims.

Although the present inventors wish to avoid being bound by any theory, they noted that although high mechanical energy is needed to effect mechanical alloying, introducing some restriction to the free displacement of the striking bodies can lead to plating, even with very hard metastable alloys and materials. It would thus appear that, in ordinary metal alloying, plating does not occur because any temporarily plated portion is soon removed by friction and abrasion consecutive to random movements of the striking media. If friction is limited by restricting the turbulent motion of the striking bodies, plating has been found to occur, possibly owing to localized kinetic energy concentration and consecutive localized heating. Such restriction of free movements can be brought about by properly devising the inside configuration of the attritor mill and imparting thereto a controlled mode of agitation.

BRIEF DESCRIPTION OF THE DRAWING

This will be explained in more details with reference to the annexed drawings.

FIG. 1 is a schematic plan view of a device for embodying the method of the invention.

FIG. 2 is a schematic longitudinal cross-section of a portion of the device of claim 1.

FIG. 3 is a schematic representation of a moving body after mechanical plating with a mechanically alloyed material.

FIG. 4 is schematic cross-cut in perspective of a variant of the device of FIG. 2.

DETAILED DESCRIPTION OF THE PRESENTLY PREFERRED EXEMPLARY EMBODIMENTS

Figure 5:
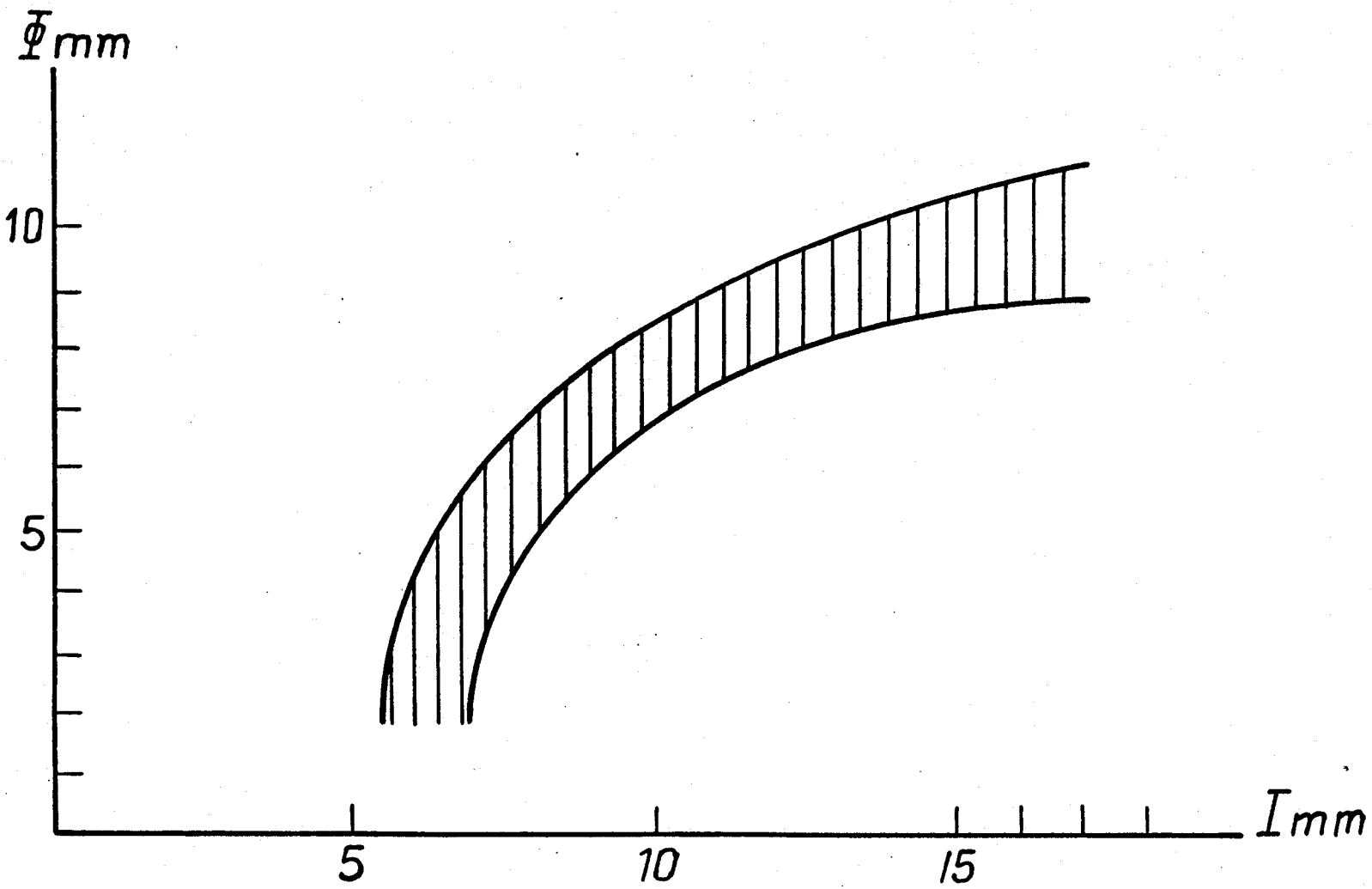
FIG. 5 is a diagram representation showing a zone in which a range of parameters promote coating with mechanical alloys.

The device schematically illustrated in FIG. 1 comprises a base plate with a slot 2 carrying a turn-table 3 mounted on a shaft 4 driven by a motor not represented. The device further comprises a sliding carriage 5 oscillatingly mounted on an underside stud 6 which fits slidingly in slot 2. The carriage is equipped with an arm 7 journaled around a shaft 8 at the periphery of the table 3 so that upon rotation thereof, the carriage 5 is subjected to a combination oscillating and reciprocating motion.

The carriage 5 retains a series of tubes 9*a*, 9*b*, 9*c* which fit snugly in the bottom thereof to that they cannot substantially clash together when the device is actuated.

The tubes of which one unit is schematically illustrated in FIG. 2 are plugged at both ends by plugs 10 and contain a series of spherical, roughly spherical or cylindrical loose bodies 11 for instance metal or ceramic spheres, the diameter of which (in the case of spheres) exceeds somewhat the cross-sectional radius of the tubes. Practially, the diameter of the spheres is at least about 10% greater than the internal cross-sectional radius of the tube; however this excess can be over 10% and be up to 50 or 60%, or even more, provided that the spheres can still move freely in the axial direction.

Alternatively, the carriage 5 supports a gastight canister containing an array of tubes, the bottom and top ends of the canister serving as plugs for the tubes.

The tube also contains a portion of particles 12 of the elements to be alloyed together, for instance nickel and aluminium in correct stoichiometric proportions for achieving a predetermined alloy or intermetallic composition. The amount of the particles in powder form can range from about 1 to 30% by volume of the spheres and the particle size is very variable and usually range from less than a micron to several hundreds of microns, preferably from 30 to 100 μm.

During operation, the wheel 3 is rotated and the carriage oscillates and reciprocates simultaneously; the balls within the tube strike at each other longitudinally but, since they have a diameter relatively large compared to the tube cross-section, they cannot pass over each other and mutual friction is minimized. Therefore the elements which are mechanically alloyed by the shock energy delivered by the balls finally deposit on the ball surface to provide a coating.

Furthermore, within a given range of operating parameters such as oscillation and translation amplitude and frequency, number, diameter and weight of the balls in relation with length and cross-section of the tubes, the balls rotate under shock by steps according to some discrete angular values, whereby the alloy preferentially deposits at spots on the surface of the balls, the pattern and the location of the spots depending on the operating conditions. After a time of operation, the coating on the balls will thus appear as depicted in FIG. 3 i.e. comprising a series of protuberances or projections protruding radially from the surface of the coating. The height of these projections can be in the range of 0,1–0,3 ball diameter. It may be assumed that some resonance phenomena are involved here.

After thoroughly studying the variable parameters in this invention, it has been noted that the conditions required to obtain coatings are determined primarily by:

the oscillation frequency (R oscillations per min.) and the distance D of excursion of the balls, the internal diameter I of the tube (this being so for the coating of spherical or closely spherical bodies), the diameter of the spheres Φ the packing length fraction f which is the number of the spheres times their diameter divided by the length L of the tube, i.e. the fraction of the length of the tube that is occupied by the striking bodies, the length of the tube (L).

For a given set of values of L, f, R and D, the coating sequence is given in an area of the Φ, I space shown by the shaded area in the diagram represented in FIG. 5. This diagram was established using the following values: L=80 mm; f=0.5; D=20 mm and R=300/min.

At very small sphere diameters, the kinetic energy is insufficient to achieve efficient coating and R must be increased. For large sphere diameters, it appears that there is a critical limit above which coating no longer occurs. This is because the inertia of the spheres becomes too large for them to be properly set into motion; hence R must be decreased.

The upper coating limit at intermediate diameters corresponds to approximately $I=1.1\Phi$, i.e. the spheres are 10% larger than the internal radius of the tube. The lower limit is given by $I=2\Phi$, i.e. when the spheres can slide beside each other.

Small objects with a very hard surface like that illustrated by FIG. 3 are very useful deburring agents. FIG. 4 illustrates schematically a portion of a tube 15 of rectangular or square cross-section in which small cylinders 16 operate as clashing bodies to first mechanically alloy particulate elements (not shown) and then build a coating of alloy on the surface. Cylindrical deburring agents can be obtained in this variant of the invention.

The following examples illustrate the invention.

EXAMPLE 1

A device was used involving 20 tubes 8 cm long and 20 mm diameter containing each 6–7 stainless steel balls of about 10 mm diameter, 35 g of nickel powder (particles 30–100 μm) and 51 g of aluminum powder (particles 30–100 μm). The powders were well blended together and the mix was evenly distributed among the tubes. Before closing, the tubes were flushed and filled with argon.

The amplitude of the reciprocating motion was 20 mm back and forth at frequency of 5 $sec^{-1}$.

The oscillating distance D was about 20 mm. The machine was operated for 5 hrs after which the tubes were opened and the balls were removed.

The surface of the balls was coated with a Ni/Al alloy (83.7% Ni/12.7% Al), this coating being dotted with an average of 1 projection/$mm^2$ of about 1,5 mm high.

EXAMPLE 2

A device like that of Example 1 but of reduced size was used with 5 tubes of stainless steel 80 mm long of diameters indicated in the next table and with spheres (material and diameters also shown in the table).

The metal powder was a blend of 23.33 g Cu (45–100 μm) and 10.0 g of Al (45–100 μm) evenly distributed in the tubes (atmosphere of argon under reduced pressure).

The device was run for 5 hrs; amplitude 15 mm; frequency 0.6 $sec^{-1}$.

The results are also shown in the table in terms of number of projections of Cu/Al alloy per square mm on the ball surface and projection height. In tube 5 no deposit was found, the balls being too small.

TABLE

| Tubes | 1 | 2 | 3 | 4 | 5 |
|---|---|---|---|---|---|
| Tube diameter (mm) | 20 | 20 | 10 | 9 | 7 |
| Ball diameter (mm) | 12 | 12 | 6 | 5 | 3 |
| Ball material | stainless | Ni | Ni | Ni | Ni |
| Packing factor | 0.75 | 0.45 | 0.45 | 0.38 | 0.23 |
| Projection density ($mm^{-2}$) | 1.1 | 1.1 | 0.9 | 0.8 | — |
| Height of project. (mm) | 0.8 | 0.7 | 0.8 | 0.6 | — |

EXAMPLE 3

The experiment of Example 2, tube 1 was repeated using a blend of 5.0 g Al powder (45–100 μm) and 28.33 g Cu powder (45–100 μm). The machine was operated as in Example 2 but for 24 hrs under ordinary pressure of Ar. The balls were coated with 0.8 projections/$mm^2$, 0.8 mm high of a Cu-Al alloy.

EXAMPLE 4

A blend of 18.67 g iron powder (5–50 μm), 5.32 g chromium (2–20 μm) and 2.67 g Al (10–100 μm) was used together with 20 mm diameter alumina and stainless tubes under argon. The balls were 12 mm stainless, alumina and nickel (packing factor 0.75).

The device was that of Example 2 and was operated for 5 hrs at 0.6 $sec^{-1}$.

In all cases were deposits obtained. The density of projections was 0.5–1.5/$m^2$ depending on the balls and peak height 0.5–1.0 mm approximately.

EXAMPLE 5

A rectangular cross-sectional stainless tube (12×9 mm), length 80 mm, was used. Packing was achieved with 8 stainless cylinders 10 mm long 6 mm diameter. The powder was that of Example 4 (3 g). After 5 hrs of operation, examination of the cylinders showed that an alloy deposit had formed on the cylindrical surface (about 1 projection/$mm^2$, 0.5–0.8 mm high).

We claim:

1. A mechanical alloying and plating method for forming an adherent coating on moving bodies in which a particulate metal constituent and one or more other metal or mineral constituents are subjected to violent agitation by mechanical means in the inside of a closed vessel in the presence of a charge of loose hard bodies which, under agitation, strike against each other and walls of the vessel so that kinetic energy is generated that crushes, attrites, welds and alloys said constituents together, said method comprising the steps of:

controlling movement and rotations of the moving bodies inside of said vessel by utilizing an interior shape of the vessel, limiting linear and angular displacements, and minimizing rubbing of said bodies against each other and the walls of the vessel, thereby reducing the loss of alloy particles mechanically bound to the bodies, and progressively forming an adherent alloy coating on said bodies.

2. The method of claim 1, further comprising the step of restraining angular displacement of the moving bodies to a set of discrete values via an operating mode of an agitating means, whereby the alloy coating is preferentially deposited at corresponding discrete spots on the surface of said bodies.

3. The method of claim 1, wherein the moving bodies have at least one surface that is a surface of revolution around an axis.

4. The method of claim 3, wherein said at least one surface is spherical, cylindrical or frustoconical.

5. The method of claim 3, wherein average cross-sectional size of said moving bodies exceeds a cross-sectional radius of the vessel.

* * * * *